US005321960A

United States Patent [19]

Whitt et al.

[11] Patent Number: 5,321,960

[45] Date of Patent: Jun. 21, 1994

[54] ABRASION RESISTANT REINFORCED FABRIC

[75] Inventors: Caleb C. Whitt, Madison; Rudolph W. Howard, Pittsboro; Boyce J. Asbill; Denise C. Yow, both of Asheboro, all of N.C.

[73] Assignee: Kayser-Roth Corporation, Greensboro, N.C.

[21] Appl. No.: 10,637

[22] Filed: Jan. 28, 1993

[51] Int. Cl.[5] ..... D04B 9/46; D04B 1/16; D02G 3/02

[52] U.S. Cl. ..... 66/182; 57/236; 66/202

[58] Field of Search ..... 66/182, 202; 57/211, 57/227, 230, 236, 237

[56] References Cited

U.S. PATENT DOCUMENTS

| | | | |
|---|---|---|---|
| 2,138,950 | 12/1938 | Whitehead | 117/21 |
| 2,737,035 | 3/1956 | Bryan et al. | 66/182 |
| 2,810,949 | 10/1957 | Silver . | |
| 3,092,955 | 6/1963 | Smit | 57/140 |
| 3,117,410 | 1/1964 | Crouzet | 57/140 |
| 3,201,930 | 8/1965 | Stirling | 57/230 X |
| 3,301,018 | 1/1967 | Knohl | 66/202 |
| 3,451,232 | 6/1969 | Belzidsky | 66/182 |
| 3,690,056 | 9/1972 | Peters | 57/237 |
| 3,940,917 | 3/1976 | Strachan | 57/152 |
| 4,121,408 | 10/1978 | Maeda | 57/12 |
| 4,150,529 | 4/1979 | Northup | 57/6 |
| 4,186,471 | 2/1980 | Wehrmann et al. | 66/182 X |
| 4,341,097 | 7/1982 | Cassidy, Sr. et al. | 66/187 |
| 4,467,595 | 8/1984 | Kramers | 57/225 |
| 4,554,121 | 11/1985 | Kramers | 264/103 |
| 4,563,869 | 1/1986 | Stanton | 57/211 |
| 4,918,912 | 4/1990 | Warner | 57/255 |
| 5,199,253 | 4/1993 | Berger | 57/236 |

FOREIGN PATENT DOCUMENTS

| | | | |
|---|---|---|---|
| 1239131 | 9/1989 | Japan | 57/237 |

*Primary Examiner*—Clifford D. Crowder
*Assistant Examiner*—John J. Calvert
*Attorney, Agent, or Firm*—Curtis, Morris and Safford

[57] ABSTRACT

A reinforcing yarn and an abrasion resistant knitted fabric made therewith are disclosed. The reinforcing yarn is made by Z twisting one end of a "Z"-twist textured yarn together with one end of a "S"-twist textured yarn to yield an S/Z yarn pair, which is then reverse twisted together with a duplicate S/Z yarn pair to yield a 4-end multi-twisted reinforcing yarn. This reinforcing yarn is knit in plaited relationship to the body yarn of a fabric to produce a fabric with exceptional abrasion resistance.

28 Claims, 3 Drawing Sheets

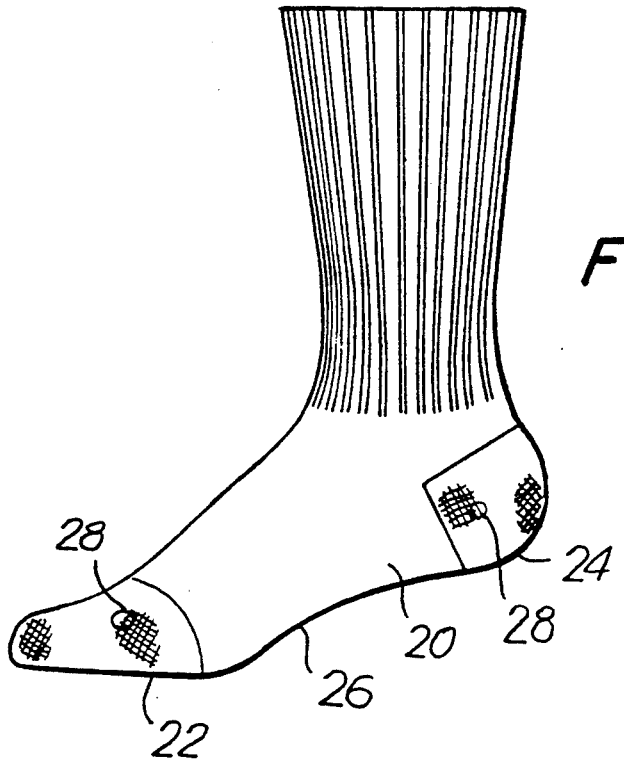
FIG. 3
FIG. 4
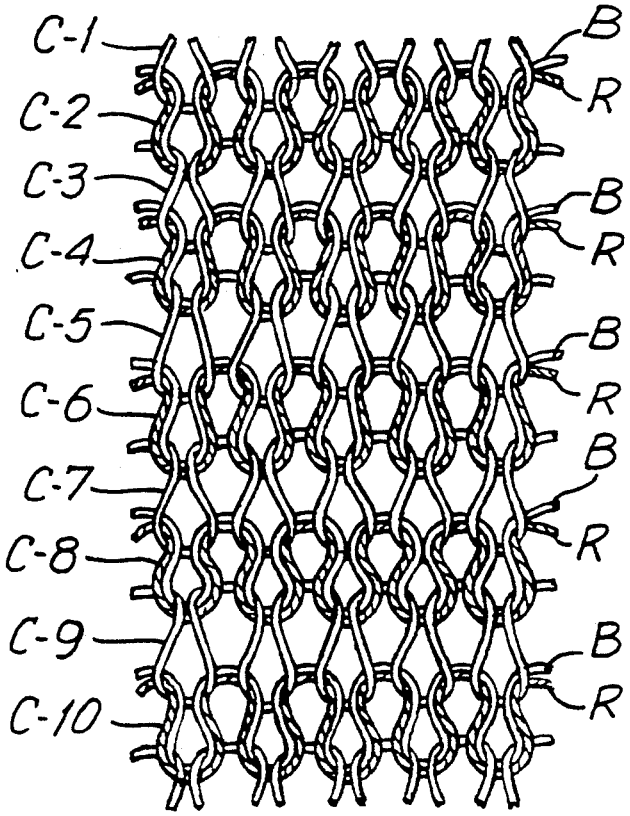

ABRASION RESISTANT REINFORCED FABRIC

BACKGROUND OF THE INVENTION

The present invention relates to a reinforcing yarn and fabric having high abrasion resistance made therewith. The abrasion resistance enabled with the yarn of the invention is particularly useful in socks, the knees of pants and the elbows of shirts.

Since the tendency to develop holes during wear is particularly troublesome with socks, the invention will be described with particular reference to socks.

Socks are typically subjected to the greatest wear in the heel and toe regions. Consequently, to improve the wear life of socks, manufacturers have incorporated reinforcement in the heel and toe regions. Toe and heel reinforcements have frequently been used in socks made of cotton, wool and acrylic, or blends thereof, with the most common method being to incorporate a reinforcing yarn by knitting it into the sock in alternating courses with the body yarn of the sock, or, alternatively, plaiting the reinforcing yarn on the main/primary yarn of the sock.

While prior efforts to produce more durable socks using reinforcing yarn as aforedescribed have increased their abrasion resistance, they have not been entirely successful inasmuch as it is still commonplace for socks to wear through in the heel or toe when the remainder of the sock is still in a wearable condition. Efforts to produce socks having improved wear performance have recently focused on the incorporation of para-aramid fibers into sock yarn, to improve abrasion and cut-resistance. An example of such an attempt is described in U.S. Pat. No. 4,918,912. The blended fiber spun yarn described in this patent is said to exhibit a surprising combination of abrasion and cut-resistance. However, para-aramid fiber is considerably more expensive than conventional sock fibers, so any superior results achieved through the use of para-aramid fiber is presumed to come with a price disadvantage.

SUMMARY OF THE INVENTION

It has now been found that a fabric having extraordinary resistance to abrasion can be made by plaiting a special composite reinforcing yarn on a primary/body yarn and knitting the same into the fabric where high abrasion resistance is required. The composite reinforcing yarn which has been found to provide extraordinary resistance to abrasion is made by Z twisting one end of a "Z" twist textured yarn together with one end of an "S" twist textured yarn to yield a S/Z yarn pair, and then taking the S/Z yarn pair and twisting it together in the S direction with a duplicate S/Z yarn pair to yield a four end multi-twisted, torque-balanced reinforcing yarn. This four end reinforcing yarn is knit into a fabric, in plaited relationship to the body yarn of the fabric.

The preferred reinforcing yarn for use in the invention is twisted textured nylon. Other types of textured yarns, such as polyester, can also be used to make reinforcing yarn according to the invention, inasmuch as it is the composite twisted structure of the reinforcing yarn which provides the principal contribution to the abrasion resistance achieved.

Fabrics made with the described reinforced plaited yarn have a good "hand" or feel, which is desirable for wearing apparel worn adjacent to the skin.

The single ends of Z-twist textured yarn and S-twist textured yarn used in the invention have a minimum of about one turn per inch and preferably about two to four turns per inch. Preferably, the Z-twist yarn end and the S-twist yarn end in each S/Z yarn pair have the same number of turns of twist per inch, but in the opposite direction, and the ends of Z-twist yarn and S-twist yarn are plytwisted together in the Z direction with the same number of turns per inch as is in each of the individual S and Z yarn ends. The S/Z yarn pair so produced has a slight torque in the Z direction. The composite four-end, multi-twisted reinforcing yarn of the invention is preferably produced by S-twisting together duplicate S/Z yarn pairs with a minimum of one turn per inch, and preferably about two to six turns per inch. The resulting composite reinforcing yarn has balanced twist and can be characterized as a nontorque yarn.

In accordance with the present invention, an appropriate denier body yarn is knit to form successive courses beginning at the top and extending throughout the leg, foot and toe regions of a hosiery article. If the hosiery article is to be an athletic sock, it is customary for a relatively high denier body yarn to be employed, whereas in a dress-weight sock, a somewhat finer body yarn is used, and in sheer hosiery, a fine denier body yarn is used. Basically, the fiber used in a hosiery article, or other article made of fabric, is a matter of choice, which is governed by the properties desired. The benefits of the present invention are achieved with body yarns of any composition or size.

The reinforcing yarn according to the invention is knit in plaited relationship with the body yarn of an article in all sections of the article in which enhanced abrasion resistance is required. Of course, it is also possible to incorporate reinforcing yarn throughout the entire article, although this is generally unnecessary. Where maximum abrasion resistance is desired, the reinforcing yarn is knit in plaited relationship with the body yarn in each course of yarn. Alternatively, if somewhat lesser abrasion resistance is required, it can be achieved by knitting the reinforcing yarn according to the invention in plaited relationship to the body yarn in alternating or spaced apart courses of yarn. Since the wear resistance of a fabric is improved when the reinforcing yarn of the invention is incorporated in spaced apart yarn courses, in many cases, it will be unnecessary to incur even the relatively minor additional expense of incorporating reinforcing yarn in all of the courses of the toe and heel regions of a hosiery article. For example, where less than maximum abrasion resistance is required, the reinforcing yarn of the invention can be knit in plaited relationship with the body yarn in alternating courses, or even in every third, fourth, fifth or sixth course of yarn in the areas where high abrasion resistance is desired.

BRIEF DESCRIPTION OF THE DRAWINGS

The invention, as well as its objects and features, will be better understood by reference to the following detailed description of the preferred embodiments of this invention, in conjunction with the accompanying drawings, which are incorporated in and form a part of this specification. In drawings:

FIG. 3 is an elevational view of one side of a sock, illustrating the incorporation of reinforced toe and heel sections according to the invention; and FIG. 4 is a greatly enlarged elevational view of the knitted fabric in the area of circles 28 in FIG. 3, illustrating the manner in which reinforcing yarn is knit in plaited relationship with the body yarn in every other course.

DETAILED DESCRIPTION OF THE INVENTION

Figure 1:
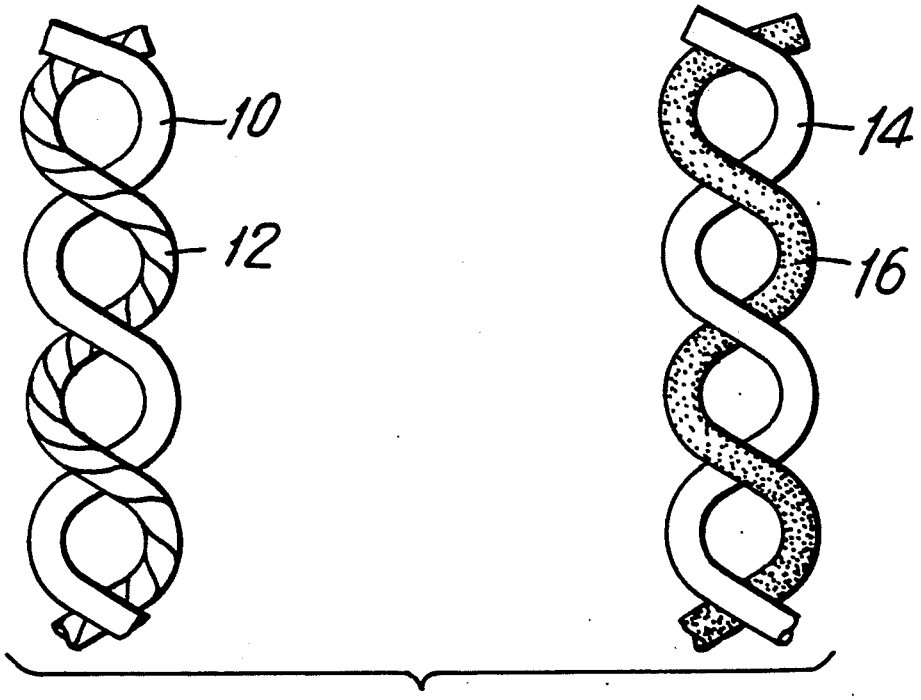
FIG. 1 is an elevational view of two S/Z yarn pairs used in the invention.
Figure 2:
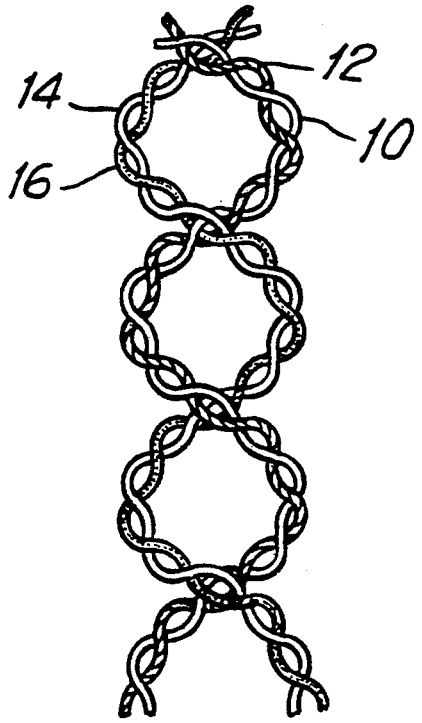
FIG. 2 is an elevational view of a composite multi-end reinforcing yarn comprised of two S/Z yarn pairs depicted in FIG. 1.

As best depicted in FIG. 2, reinforcing yarn R is made by first mechanically Z twisting one end of Z-twist textured yarn 10 together with one end of an S (reverse)-twist textured yarn 12, yielding a S/Z yarn pair. Methods for mechanically twisting yarns together are well know to those skilled in the art, and are described in numerous patents, such as, for example, U.S. Pat. Nos. 2,134,022 and 3,284,996. Yarn ends 10, 12, 14 and 16 are preferably multi-filament textured yarns, in the size range of about 10 to 200 denier and preferably from about 20 to 100 denier, having at least about one turn per inch and preferably two to four turns per inch. Z-twist yarn end 10 and S-twist yarn end 12 are plytwisted together in the Z direction with about the same number of turns of twist per inch as is in textured yarns 10 and 12. The resulting yarn pair 10/12 is substantially symmetrical about its central axis, but has a slight torque in the Z direction. Z-twist yarn end 14 and S-twist yarn end 16 are also plytwisted together in a Z direction with about the same number of turns per inch as in textured yarns 14 and 16. The resulting yarn pair 14/16 is substantially symmetrical about its central axis and similarly has a slight torque in the Z direction.

Yarn pair 10/12 is mechanically S twisted together with yarn pair 14/16. Yarn pairs 10/12 and 14/16 are preferentially twisted together with at least one turn per inch and preferably two to six turns per inch. The S twist used to combine yarn pairs 10/12 and 14/16 constitutes a "reverse" twisting of yarn pairs 10/12 and 14/16 by virtue of its utilization of a twisting direction which is opposite to the Z torque introduced into pairs 10/12 and 14/16 upon their being plied. In this fashion, the torque in yarn pairs 10/12 and 14/16 are canceled or balanced, producing a composite yarn R which does not rotate or kink when it is permitted to hang freely.

In the described embodiment of the invention, yarns 10, 12, 14 and 16 have the same fiber composition, the same number of filaments, substantially the same yarn denier and substantially the same number of turns per inch, so as to produce yarn pairs which have about the same torque, whereby reversing twisting yarn pairs 10/12 and 14/16 together as described yields a balanced nontorque composite yarn. The aforedescribed yarn characteristics can however be varied, if substantial symmetry is maintained between the respective elements of yarn pairs 10/12 and 14/16, or, alternatively, they can be varied without regard for symmetry, if appropriate tension is maintained on a resulting unbalanced reinforcing yarn, to keep it from kinking or rotating when it is plaited to a body yarn in accordance with the invention.

Sock 20 with reinforced toe section 22 and heel section 24 is illustrated in FIG. 3. As can best be seen in FIG. 4, sock 20 is knit of a body yarn B, forming successive courses (C-1 through C-10) of stitch loops. Although not shown in FIG. 4 in the interest of clarity, in many socks, a stretch or elastic yarn is plaited onto body yarn B in every course thereof. The purpose of such a stretch or elastic yarn is to enhance the sock's stretch and fit. Sock 20 could incorporate such a fit enhancing yarn and reinforcing yarn R is not intended in any way to replace fit-enhancing yarns. For example, if sock 20 were to be a sports sock wherein body yarn B might be a spun yarn of acrylic and/or cotton, it would be typical for the body yarn B to have a fit-enhancing stretch nylon yarn plaited to it throughout the sock. In the described acrylic/cotton sports sock, a typical stretch yarn that might be utilized would be a 34 filament 100 denier stretch nylon. Where necessary for fit in a sock or other garment, body yarn B in FIG. 4 should be understood to represent the composite of a body yarn and an appropriately applied stretch yarn.

Arch section 26 in Sock 20 does not incorporate reinforcing yarn R, because enhanced abrasion resistance is not required in arch section 26.

Figure 5:
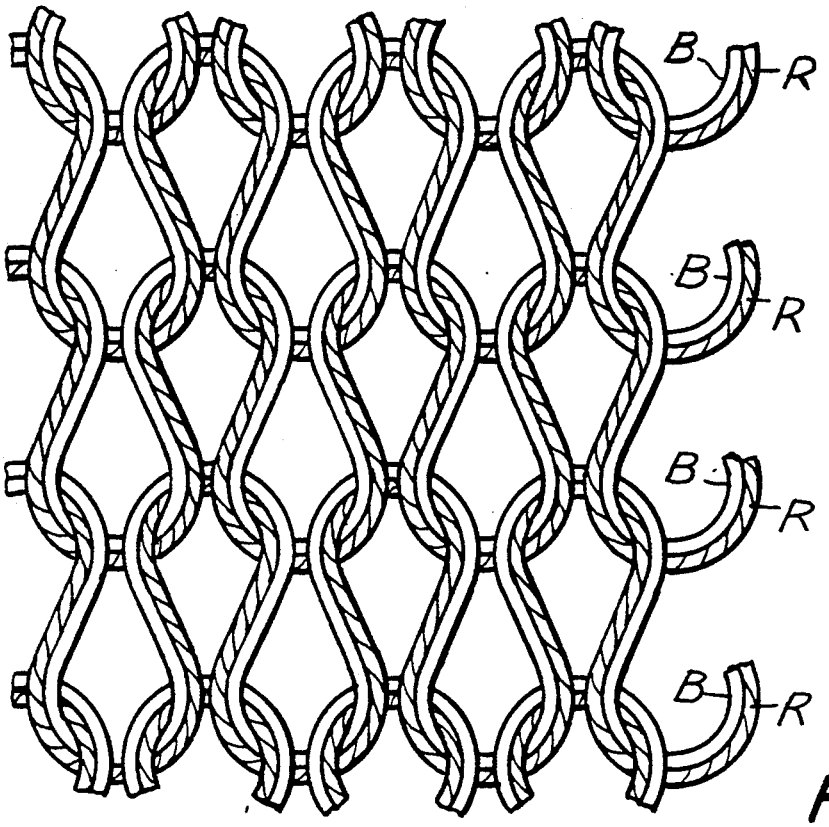
FIG. 5 is a greatly enlarged elevational view of a second embodiment of the knitted fabric according to the invention, wherein the reinforcing yarn is knit in plaited relationship with the body yarn in every course.

As shown in FIG. 4, reinforcing yarn R is knit in plaited relationship with body yarn B in every other course (courses C-2, C-4, C-6, C-8, C-10) of yarn in toe 22 and heel 24 of sock 20. With reinforcing yarn R knit in plaited relationship with the body yarn B in every other course of yarn enhanced, although not maximum, abrasion resistance is imparted thereto. Where maximum abrasion resistance is required, reinforcing yarn R would be knit in plaited relationship with every course of body yarn B, as shown in FIG. 5.

Figure 6:
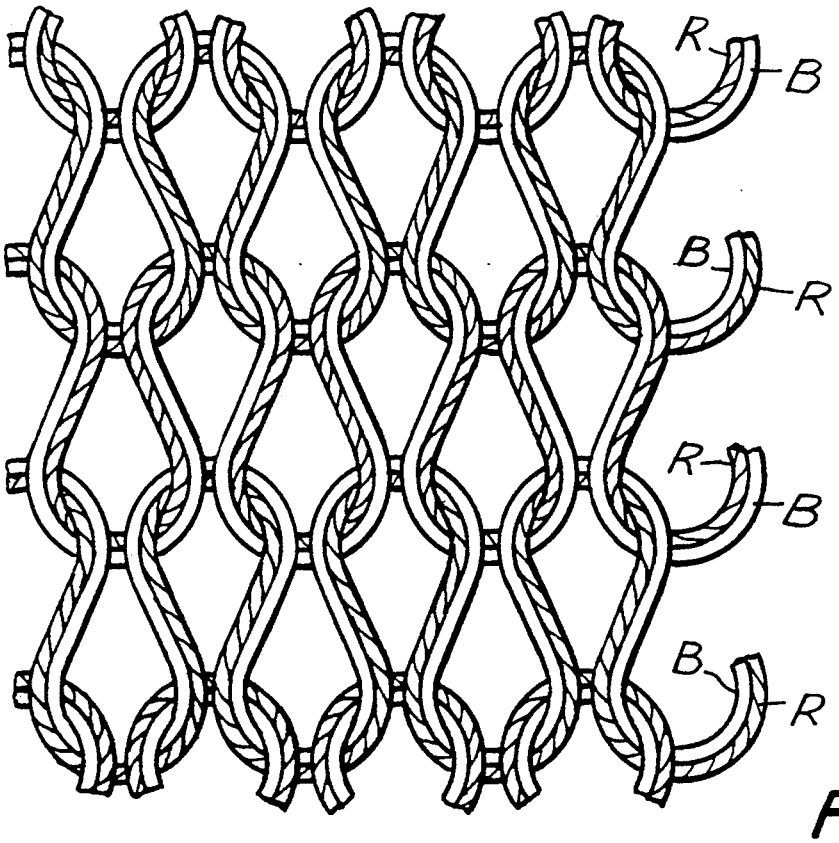
FIG. 6 is a greatly enlarged elevational view of a third embodiment of the knitted fabric according to the invention, wherein the reinforcing yarn is plaited on every course of the body yarn, but alternates its position relative to the body yarn from the inside face of the fabric to the outside face of the fabric.

In another, preferred embodiment of the invention, depicted in FIG. 6, reinforcing yarn R is knitted in plaited relationship with body yarn B in every course of toe 22 and heel 24, but alternates its position relative to body yarn B, that is from the inside of the fabric to the outside of the fabric, in every other course. This alternate relative placement of reinforcement yarn R and body yarn B is achieved by changing the order in which yarn is fed into the needles of the circular knitting machine used to make sock 20. Basically, the yarn fed nearest the head of the needle goes to the front of the needle hook when a loop is being formed, and ultimately knocks over to the back side of the knitted fabric. For the courses where it is desired that reinforcement yarn R be positioned on the back side of the fabric, reinforcement yarn R is fed nearest the head of the knitting needle, with body yarn B behind it. In the next succeeding course, where the reverse plaiting is desired, body yarn B is fed nearest the head of the needle and goes to the front of the needle hook, whereupon when the knit loop is being formed, body yarn B knocks over so that it is on the surface of the back side of the fabric.

As a specific but not limiting example, it has been found that a hosiery article having extraordinary wear resistance can be made with reinforcing yarn R which is comprised of textured yarn ends 10, 12, 14 and 16, all of which are 34 filament 100 denier textured nylon with two turns per inch (in the counterclockwise direction for the S yarns 12 and 16 and in the clockwise direction for the Z yarns 10 and 14). Yarn ends 10 and 12 are mechanically twisted together in the Z direction with approximately 2 turns per inch. Yarn ends 14 and 16 are twisted together in the same way to produce substantially identical yarn pairs 10/12 and 14/16. Yarn pairs 10/12 and 14/16 are then "reverse" twisted together in the S direction with about three turns per inch. The resulting reinforcing yarn R is a balanced nontorque yarn. In this example, sock 20 is an acrylic sport sock and reinforcing yarn R is plaited on each course of a 450 denier high bulk acrylic body yarn B in the toe 22 and heel 24 of sock 20 with reinforcing yarn R alternating in every other course from a plaited position on the outside of body yarn B to a position on the inside of body yarn B. Since a high bulk acrylic yarn has insufficient elasticity to provide the desired fit in most sock constructions, a 34 filament 100 denier stretch nylon would ordinarily also be applied to body yarn B throughout every yarn course of sock 20. The reinforced sock so produced has abrasion resistance in excess of any known commercially available acrylic sock, including conventionally reinforced acrylic socks.

Another example of a hosiery article in which the reinforcing yarn of the invention provides extraordinary wear resistance is a dress cotton sock, wherein body yarn B could comprise a mercerized cotton yarn of approximately 210 denier. To provide cotton body yarn B with adequate stretch for fit, it incorporates plaited stretch yarn throughout the entire sock consisting of two ends of 17 filament 50 denier nylon stretch yarn. These stretch yarns are not separately shown in the drawings wherein body yarn B should be deemed to include the described fit enhancing yarns. In the dress cotton sock of this example, textured yarn ends 10, 12, 14 and 16 would all be 17 filament 50 denier textured nylon with approximately three turns per inch (in a counterclockwise direction for the S yarns 12 and 16 and in a clockwise direction for the Z yarns 10 and 14). Yarn ends 10 and 12 are mechanically twisted together in the Z direction with approximately three turns per inch. Yarn ends 14 and 16 are mechanically twisted together in the same way to produce substantially identical yarn pairs 10/12 and 14/16. Yarn pairs 10/12 and 14/16 are then are then reverse twisted together in the S direction at three turns per inch. The resulting reinforcing yarn R is a balanced nontorque yarn. Reinforcing yarn R is plaited on the cotton body yarn B in the toe 22 and heel 24 of sock 20 but is applied only to alternating courses of body yarn B, as depicted in FIG. 4. In this example, reinforcing yarn R is plaited on the outside of body yarn B in each course in which it is incorporated. The reinforced sock 20 so produced has superior wear resistance. It will be appreciated that while, in this example, reinforcing yarn R is incorporated only in every other course of yarn in toe 22 and heel 24 of sock 20, if maximum abrasion resistance were to be desired, reinforcing yarn R would be applied to every course of body yarn B.

Another example of an abrasion resistant sock according to the invention is a dress nylon. In such a sock, body yarn B comprises three ends of 34 filament 70 denier nylon. Because of the excellent stretch characteristics of the body yarn in the described nylon sock, unlike the prior examples, a stretch yarn is not incorporated to enhance fit. In this example, yarn ends 10, 12, 14 and 16 are all 10 filament 30 denier textured nylon with two turns per inch (in the counterclockwise direction for the S yarns 12 and 16 and in a clockwise direction for the Z yarns 10 and 14). Yarn ends 10 and 12 are mechanically twisted together in the Z direction with approximately two turns per inch. Yarn ends 14 and 16 are mechanically twisted together in the same way to produce substantially identical yarn pairs 10/12 and 14/16. Yarn pairs 10/12 and 14/16 are then are then reverse twisted together in the S direction at four turns per inch. The resulting reinforcing yarn R is plaited on each course of nylon body yarn B in the toe 22 and heel 24 of sock 20. In this example, reinforcing yarn R is plaited on the outside of body yarn B in each yarn course in toe 22 and heel 24.

While the instant invention has been illustrated with specific examples wherein body yarn B was comprised of acrylic, cotton and nylon, and reinforcing yarn R was comprised of nylon yarn ends, extraordinary abrasion resistance would also be provided using the invention if body yarn B were to consist of any other fiber or combination of fibers and/or reinforcing yarn R were to be comprised of a fiber other than nylon, such, for example, polyester or para-aramid fiber.

In the drawings and the specification, there has been set forth the best mode presently contemplated for the practice of the present invention, and although specific terms are employed, they are used in a generic and descriptive sense only and not for purposes of limitation, it being intended that the scope of the invention be limited solely by the appended claims.

What is claimed is:

1. A reinforced knitted fabric comprised of successive courses of a body yarn having a reinforcing yarn knit in plaited relationship therewith in at least every sixth course, wherein said reinforcing yarn is comprised of two pairs of yarn ends, the first pair of yarn ends comprising a first end of a textured yarn having between approximately 1 and 4 turns of S-twist per inch and a second end of textured yarn having about same number of turns of twist per inch as said first end of yarn but in the Z-twist direction, said first and second yarn ends being mechanically plytwisted together in a first direction with approximately the same number of turns per inch as is in said first end of textured yarn, the second pair of yarn ends comprising a third end of textured yarn having between approximately 1 and 4 turns of S-twist per inch and a fourth end of textured yarn having about the same number of turns of twist per inch as said third end of yarn but in the Z-twist direction, said third and fourth yarn ends being mechanically plytwisted together in the same direction as said first and second yarn ends, and said first pair of yarn ends and said second pair of yarn ends being mechanically twisted together with between approximately 1 and 6 turns per inch in a direction opposite to that used to plytwist said first and second yarn ends together.

2. A reinforced knitted fabric according to claim 1, wherein said first, second, third and fourth ends of textured yarn in said reinforcing yarn are comprised of plied yarns in the 10 to 200 denier size range, and said plied yarns are comprised of fibers selected from the group of nylon, polyester and para-aramid.

3. A reinforced knitted fabric according to claim 1, wherein said first, second, third and fourth ends of textured yarn in said reinforcing yarn are comprised of plied yarns of nylon in the 20 to 100 denier size range.

4. A reinforced knitted fabric according to claim 1, wherein said first, second, third and fourth ends of textured yarn in said reinforcing yarn are comprised of plied yarns in about the 20 and 100 denier size range, and wherein each of said first, second, third and fourth ends of textured yarn have between approximately 2 and 4 turns per inch, and said first and second yarn pairs are twisted together with between approximately 2 and 4 turns per inch.

5. A reinforced knitted fabric according to claim 4, wherein said first, second, third and fourth ends of textured yarn in said reinforcing yarn are comprised of plied stretch nylon, and wherein each of said first, second, third and fourth ends of textured yarn have between approximately 2 and 4 turns per inch, and said first and second yarn pairs are twisted together with between approximately 3 and 4 turns per inch.

6. The reinforced knitted fabric according to claim 4, wherein said reinforcing yarn is plaited on the body yarn in every course thereof.

7. The reinforced knitted fabric according to claim 5, wherein said reinforcing yarn is plaited on the body yarn in every course thereof.

8. The reinforced knitted fabric according to claim 6, wherein said reinforcing yarn is plaited on opposite sides of said body yarn in consecutive courses, whereby said reinforcing yarn is substantially the outside yarn on the front side of the fabric in one course and is substantially the outside yarn on the back side of the fabric in the next succeeding course.

9. The reinforced knitted fabric according to claim 7, wherein said reinforcing yarn is plaited on opposite sides of said body yarn in consecutive courses, whereby said reinforcing yarn is substantially the outside yarn on the front side of the fabric in one course and is substantially the outside yarn on the back side of the fabric in the next succeeding course.

10. The reinforced knitted fabric according to claim 2, wherein said reinforcing yarn is plaited on the body yarn in alternating courses thereof.

11. The reinforced knitted fabric according to claim 5, wherein said reinforcing yarn is plaited on the body yarn in alternating courses thereof.

12. An article of clothing comprised of knitted fabric wherein at least a portion of said fabric is the reinforced knitted fabric of claim 2.

13. An article of clothing comprised of knitted fabric wherein at least a portion of said fabric is the reinforced knitted fabric of claim 5.

14. An article of clothing comprised of knitted fabric wherein at least a portion of said fabric is the reinforced knitted fabric of claim 8.

15. An article of clothing comprised of knitted fabric wherein at least a portion of said fabric is the reinforced knitted fabric of claim 9.

16. A sock comprised of knitted fabric wherein at least a portion of said fabric is the reinforced knitted fabric of claim 2.

17. A sock comprised of knitted fabric wherein at least a portion of said fabric is the reinforced knitted fabric of claim 9.

18. A sock having toe and heel sections made with the reinforced knitted fabric of claim 8.

19. A sock having toe and heel sections made with the reinforced knitted fabric of claim 10.

20. A reinforced knitted fabric comprised of successive courses of a body yarn having a reinforcing yarn knit in plaited relationship therewith at least every sixth course, wherein said reinforcing yarn is comprised of a first end of a textured yarn having between approximately 1 and 4 turns of S-twist per inch, a second end of textured yarn having approximately the same number of turns of twist per inch as said first end of yarn but in the Z-twist direction, said first and second yarn ends being twisted together with approximately the same number of turns per inch as in the first end of yarn to form a first yarn pair, a third end of textured yarn having between approximately 1 and 4 turns of S-twist per inch, a fourth end of textured yarn having approximately the same number of turns of twist per inch as said third end of yarn but in the Z-twist direction, said third and fourth yarn ends being twisted together with approximately the same number of turns per inch as in said third end of yarn to form a second pair of yarns, and said first pair of yarns and said second pair of yarns twisted together with between approximately 1 and 6 turns per inch.

21. A reinforced knitted fabric according to claim 20, wherein said first, second, third and fourth ends of textured yarn in said reinforcing yarn are comprised of plied yarns in the 10 to 200 denier size range, and said plied yarns are comprised of fibers selected from the group of nylon, polyester and para-aramid.

22. A reinforced knitted fabric according to claim 21, wherein said first, second, third and fourth ends of textured yarn in said reinforcing yarn are comprised of plied stretch nylon, and wherein each of said first, second, third and fourth ends of textured yarns have between approximately 2 and 4 turns per inch, and said first and second yarn pairs are twisted together with between approximately 3 and 4 turns per inch.

23. The reinforced knitted fabric according to claim 22, wherein said reinforcing yarn is plaited on the body yarn in every course thereof.

24. The reinforced knitted fabric according to claim 23, wherein said reinforcing yarn is plaited on opposite sides of said body yarn in consecutive courses, whereby said reinforcing yarn is substantially the outside yarn on the front side of the fabric in one course and is substantially the outside yarn on the back side of the fabric in the next succeeding course.

25. The reinforced knitted fabric according to claim 21, wherein said reinforcing yarn is plaited on the body yarn in alternating courses thereof.

26. An article of clothing comprised of knitted fabric wherein at least a portions of said fabric is the reinforced knitted fabric of claim 23.

27. An article of clothing comprised of knitted fabric wherein at least a portion of said fabric is the reinforced knitted fabric of claim 24.

28. An article of clothing comprised of knitted fabric wherein at least a portion of said fabric is the reinforced knitted fabric of claim 25.

* * * * *